US010789847B2

(12) United States Patent
Maruiwa et al.

(10) Patent No.: US 10,789,847 B2
(45) Date of Patent: Sep. 29, 2020

(54) PARKING ASSIST DEVICE, PARKING ASSIST METHOD, AND PARKING ASSIST SYSTEM

(71) Applicant: TOYOTA JIDOSHA KABUSHIKI KAISHA, Toyota-shi, Aichi-ken (JP)

(72) Inventors: Nobutsugu Maruiwa, Mishima (JP); Yoshio Mukaiyama, Mishima (JP); Ryuji Okamura, Gotemba (JP); Kazuhito Eshima, Fuji (JP); Issei Matsunaga, Owariasahi (JP); Tatsuya Sugano, Susono (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 16/564,608

(22) Filed: Sep. 9, 2019

(65) Prior Publication Data

US 2020/0143683 A1 May 7, 2020

(30) Foreign Application Priority Data

Nov. 5, 2018 (JP) ..... 2018-208429

(51) Int. Cl.
*G08G 1/00* (2006.01)
*G08G 1/14* (2006.01)

(52) U.S. Cl.
CPC ..... *G08G 1/149* (2013.01); *G08G 1/143* (2013.01)

(58) Field of Classification Search
CPC ..... G08G 1/14; G08G 1/148; G08G 1/146; G08G 1/141; G08G 1/149; G08G 1/145; B62D 15/027; B62D 15/0285; B62D 15/028; G01C 21/3415
See application file for complete search history.

(56) References Cited

U.S. PATENT DOCUMENTS

| | | | | |
|---|---|---|---|---|
| 9,984,572 | B1 | 5/2018 | Newman | |
| 2017/0329346 | A1 | 11/2017 | Latotzki | |
| 2017/0365170 | A1 | 12/2017 | Lazic et al. | |
| 2019/0126765 | A1* | 5/2019 | Seo | G08G 1/144 |
| 2020/0086853 | A1* | 3/2020 | Kumar | H04W 4/46 |

FOREIGN PATENT DOCUMENTS

| | | | |
|---|---|---|---|
| JP | 2007-262845 | A | 10/2007 |
| JP | 2015-153145 | A | 8/2015 |
| JP | 2016-076014 | A | 5/2016 |
| JP | 2017-182230 | A | 10/2017 |
| KR | 10-2005-0094307 | A | 9/2005 |

* cited by examiner

*Primary Examiner* — Toan N Pham
(74) *Attorney, Agent, or Firm* — Sughrue Mion, PLLC

(57) ABSTRACT

A parking assist device includes: a comparator configured to compare parking priorities of a first vehicle and a second vehicle, the first vehicle being a vehicle to be newly parked in a parking section, the second vehicle being an automatically travelable vehicle already parked in a first parking space; a first instruction unit configured to output, to the second vehicle, a signal instructing to exit the first parking space by automatic travel, when the parking priority regarding use of the first parking space of the first vehicle is higher than that of the second vehicle; and a second instruction unit configured to output, to the first vehicle, a signal in instructing to park in the first parking space, when the parking priority regarding the use of the first paring space of the first vehicle is higher than that of the second vehicle.

17 Claims, 8 Drawing Sheets

PARKING ASSIST DEVICE, PARKING ASSIST METHOD, AND PARKING ASSIST SYSTEM

INCORPORATION BY REFERENCE

The disclosure of Japanese Patent Application No. 2018-208429 filed on Nov. 5, 2018 including the specification, drawings and abstract is incorporated herein by reference in its entirety.

BACKGROUND

1. Technical Field

The present disclosure relates to a parking assist device, a parking assist method, and a parking assist system.

2. Description of Related Art

As devices of this type, there are known devices configured to move a vehicle already parked in a parking space to another parking space through automatic travel of the vehicle. For example, Japanese Patent Application Publication No. 2016-076014 discloses a technique of moving an already parked vehicle to a newly vacated parking space closer to an exit. According to a technique disclosed in Japanese Patent Application Publication No. 2015-153145, in the case where a vehicle of a user is parked in a location different from a desired parking location, the vehicle is moved to the desired parking location as soon as the desired parking location becomes available.

In addition, in a technique disclosed in Japanese Patent Application Publication No. 2017-182230, automatic driving vehicles are parked in order in parking frames for parallel parking, and when one of the vehicles exits, other parking vehicles are moved back and forth to secure a moving space for the vehicle to exit. In Japanese Patent Application Publication No. 2007-262845, a technique of moving a vehicle having an exit reservation to a waiting chamber on a walkway side where the vehicle can easily exit, disclosed.

SUMMARY

In the aforementioned related arts, each vehicle is moved in consideration of only the vehicles already parked, without any consideration of the vehicles that are to be newly parked (for example, vehicles that newly come in a parking lot). Accordingly, it may be difficult to provide an appropriate parking space to a vehicle that is to be newly parked.

For example, when all parking spaces are already occupied (that is, when they are full), a vehicle that is to be newly parked is unable to be parked in any parking space. In the case where the parking lot is not full, but a user wants to park his or her vehicle at a specific parking space, and the space is already occupied, then the user has no other choice but to give up the specific parking space and select another parking space.

The present disclosure provides a parking assist device capable of providing an appropriate parking space to a vehicle that is to be newly parked.

A parking assist device according to a first aspect of the present disclosure includes: a comparator configured to compare parking priority of a first vehicle and the parking priority of a second vehicle, the first vehicle being a vehicle that is to be newly parked in a parking section including at least one parking space, the second vehicle being an automatically travelable vehicle that is already parked in a first parking space included in the parking section, the parking priority being priority regarding use of the parking space; a first instruction unit configured to output, to the second vehicle, a signal instructing to exit the first parking space by automatic travel, when the parking priority regarding use of the first parking space of the first vehicle is higher than that of the second vehicle; and a second instruction unit configured to output, to the first vehicle, a signal in instructing to park in the first parking space, when the parking priority regarding the use of the first paring space of the first vehicle is higher than that of the second vehicle.

A parking assist method according to a second aspect of the present disclosure includes: comparing, by using circuitry, parking priority of a first vehicle and the parking priority of a second vehicle, the first vehicle being a vehicle that is to be newly parked in a parking section including at least one parking space, the second vehicle being an automatically travelable vehicle that is already parked in the parking section, the parking priority being priority regarding use of the parking space; outputting, by using the circuitry, to the second vehicle, a signal indicating to exit a first parking space where the second vehicle is parked by automatic travel when the parking priority regarding use of the first parking space of the first vehicle is higher than that of the second vehicle; and outputting, by using the circuitry, to the first vehicle, a signal instructing to park in the first parking space when the parking priority regarding the use of the first parking space of the first vehicle is higher than that of the second vehicle.

A parking assist system according to a third aspect of the present disclosure includes: a first vehicle; a second vehicle different from the first vehicle; and circuitry configured to compare parking priority of a first vehicle and the parking priority of a second vehicle, the first vehicle being a vehicle that is to be newly parked in a parking section including at least one parking space, the second vehicle being an automatically travelable vehicle that is already parked in the parking section, the parking priority being priority regarding use of the parking space; output, to the second vehicle, an exit signal indicating to exit a first parking space where the second vehicle is parked by automatic travel when the parking priority regarding use of the first parking space of the first vehicle is higher than that of the second vehicle; and output, to the first vehicle, a park signal instructing to park in the first parking space when the parking priority regarding the use of the first parking space of the first vehicle is higher than that of the second vehicle, wherein the second vehicle exits the first parking space by the automatic travel when the second vehicle receives the exit signal.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Embodiments of a parking assist device will be described below with reference to the accompanying drawings.

First Embodiment

A parking assist device according to a first embodiment will be described with reference to FIGS. 1 to 4.

Device Configuration

Figure 1:
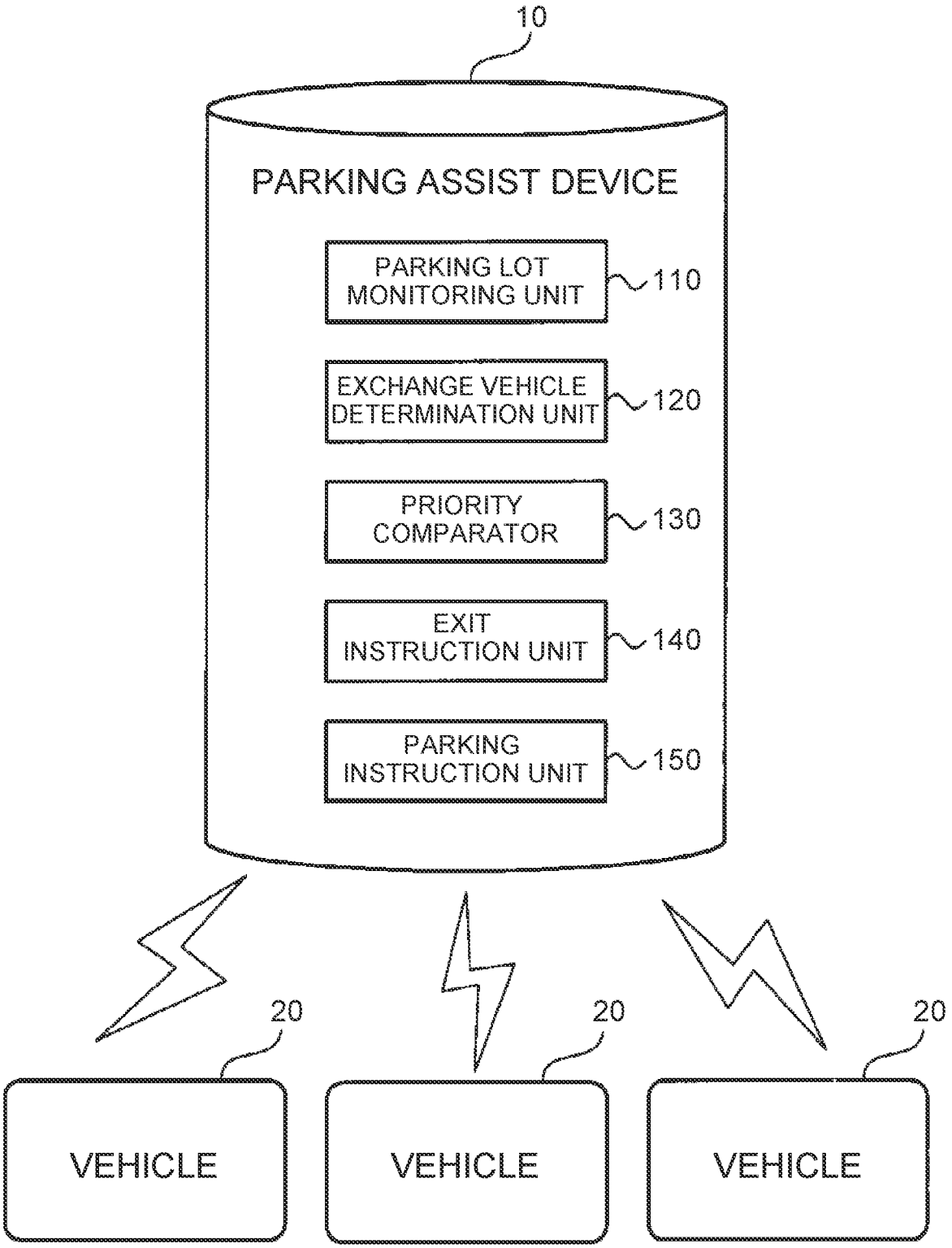
FIG. 1 is a block diagram showing the configuration of a parking assist device according to a first embodiment.

First, the configuration of the parking assist device according to the first embodiment will be described with reference to FIG. 1. FIG. 1 is a block diagram showing the configuration of the parking assist device according to the first embodiment.

In FIG. 1, a parking assist device 10 according to the first embodiment is configured as a component member of a management device in a parking lot (what is called an automated valet parking lot) that allows automatic travel and parking of vehicles 20. The parking assist device 10 is configured to be communicable with the vehicles 20 present in the parking lot or around the parking lot.

The parking assist device 10 according to the first embodiment is configured to be able to execute an operation of exchanging a vehicle (hereinafter suitably referred to as "first vehicle") that is to be newly parked and a vehicle that is already parked (hereinafter suitably referred to as "second vehicle"), in accordance with the circumstances. Specifically, the parking assist device 10 is configured to be able to move the second vehicle parked in one parking space to another place in the parking lot (that may be another parking space or may be a road on premises), while parking the first vehicle at the one parking space, as a result of which the vehicle parked in the one parking space is exchanged from the second vehicle to the first vehicle. The parking assist device 10 is configured to include a parking lot monitoring unit 110, an exchange vehicle determination unit 120, a priority comparator 130, an exit instruction unit 140, and a parking instruction unit 150, as logical processing blocks or physical processing circuits for implementing the functions.

The parking lot monitoring unit 110 is configured to be able to monitor the behavior of the vehicles 20 present in the parking lot or to monitor the state in the parking lot. The parking lot monitoring unit 110 is configured to be able to detect the location and movement of the vehicles 20 and a parking space vacancy state, with use of cameras, various sensors, or the like, (not illustrated) installed in the parking lot, for examples.

The exchange vehicle determination unit 120 is configured to be able to determine an exchange target vehicle, out of the parked second vehicles, that may be exchanged with the first vehicle. The exchange vehicle determination unit 120 determines, as the exchange target vehicle, a vehicle with a lowest parking priority among the parked second vehicles.

The parking priority is herein a parameter indicative of the degree of priority for parking in the parking space. For example, the parking priority is a value that becomes higher as exit prediction time of the vehicle 20 (time when the vehicle 20 is set to exit by an occupant of the vehicle, or the like) is later. For example, the vehicle 20 with a relatively late exit prediction time continues to park for long time thereafter, whereas the vehicles 20 with a relatively early exit prediction time ends up exiting the parking space in an early stage thereafter. Thus, it can be determined that the necessity of moving the vehicle 20 with a relatively late exit prediction time is low (in other words, the vehicle 20 should preferentially be parked in the parking space), and therefore, the parking priority thereof is set to be high. In contrast, the vehicle 20 with a relatively early exit prediction time can be determined to be highly likely to move soon (in other words, less likely to cause a problem if the vehicle 20 is made to exit the parking space), and therefore, the parking priority thereof is set to be low.

The parking priority may be set based on a cruising distance (that is, a distance cruisable with remaining fuel or electric storage amount), a fuel consumption rate (that is, a fuel amount required for travel of a unit distance) or an electric power consumption rate (that is, an electric power amount required for travel of the unit distance), and an inhibition degree in the parking lot (that is, a degree of inhibiting travel of other vehicles), in addition to or in place of the exit prediction time.

For example, when the parking space includes a charging facility for plug-in hybrid vehicles, the vehicle 20 (plug-in hybrid vehicle herein) can lengthen the cruising distance by staying in the parking space longer for charging. Accordingly, it can be determined that the vehicle 20 having a short cruising distance at present time should continuously park in the parking space in a preferential manner (that is, the vehicle 20 should continue to be charged). In contrast, it can be determined that the vehicle 20 having a long cruising distance is low in necessity for continuous charging. Accordingly, the parking priority may be set as a value that becomes higher as the cruising distance is shorter.

It can also be determined that the vehicle having a large fuel consumption rate or electric power consumption rate becomes shorter in cruising distance, whereas the vehicle having a small fuel consumption rate or electric power consumption rate becomes longer in cruising distance. Hence, the parking priority may be set as a value that becomes higher as the fuel consumption rate or electric power consumption rate is larger, as in the aforementioned example. The fuel consumption rate or electric power consumption rate can simply be determined based on whether the vehicle is a normal engine equipped vehicle (what is called a conventional vehicle), a hybrid vehicle, a plug-in hybrid vehicle, or an EV vehicle.

When the vehicle having a large inhibition degree exits a parking space, there is a higher possibility that the vehicle may inhibit travel of other vehicles in a roadway in the parking lot. For example, the vehicle with a large body tends to be obstructive for other vehicles. In contrast, the vehicle with a small body (for example, a light vehicle) is less likely to be obstructive for other vehicles. Hence, the parking priority may be set as a value that becomes higher as the inhibition degree is larger. When the parking priority is set based on the inhibition degree as described above, it is inevitable that the vehicles with a small body are preferentially determined as the exchange target vehicles. This makes it possible to eliminate an inadequate case where, for example, a light vehicle is parked in a large parking space that is for large-sized vehicles (that is, a case where the parking space is not efficiently used). The inhibition degree is calculable by using, for example, a vehicle width and a vehicle length of the pertinent vehicle. Alternatively, it is also possible to simply determine the inhibition degree based on whether the vehicle is a large-sized vehicle, an ordinary vehicle, or a light vehicle.

In addition, the vehicles of the members of a facility that owns the parking lot, and the vehicles having a parking fee hour rate set to be higher than other users may be set to have a high parking priority. The parking priority may also be set to be higher as the frequency of using the parking lot is higher. In this way, the vehicles of the users who satisfy specific conditions, such as users who pay higher fees, and users who are profitable customers, may have a higher priority degree.

Incidentally, the parking priority can also be set by combining two or more conditions as described above. In that case, a score may be calculated for each of the conditions, and the parking priority may be set based on a total value or an average value of the scores. Alternatively, when the later-described priority comparator 130 compares the parking priority set based on one condition, and values indicating the comparison results are equal (that is, high-low of the parking priority cannot be determined), the priority comparator 130 may use the parking priority set based on other conditions.

The priority comparator 130 is configured to be able to compare the parking priority of the first vehicle and the parking priority of the second vehicle. In this configuration, the comparison result by the priority comparator 130 is output to both the exit instruction unit 140 and the parking instruction unit 150. The priority comparator 130 is a specific example of the later-described comparator.

The exit instruction unit 140 is configured to be able to output to an already parked second vehicle an instruction to exit from the parking space. More specifically, when the parking priority of the first vehicle is higher than the parking priority of the second vehicle, the exit instruction unit 140 outputs to the second vehicle an instruction to exit from the parking space where the second vehicle is currently parked. Movement of each of the vehicles 20 in this case will be described in detail later. The exit instruction unit 140 is a specific example of "first instruction unit" described later.

The parking instruction unit 150 is configured to be able to output to the first vehicle that is to be newly parked an instruction to park in a vacant parking space. When the first vehicle is a vehicle that can travel automatically, the parking instruction unit 150 outputs to the first vehicle an instruction to park by automatic travel. The parking instruction unit 150 may cause the first vehicle to output, to a driver of the first vehicle, an instruction to park in a vacant parking space by using sounds, a display, and the like. The parking instruction unit 150 is a specific example of "second instruction unit" described later. However, the exit instruction unit 140 and the parking instruction unit 150 may be configured as one processing block.

In the case where the parking lot managed by a management device including the parking assist device 10 accepts vehicles that cannot travel automatically (that is, vehicles that travel with parking operation performed by a drivers), as well as vehicles that can travel automatically, the parking instruction unit 150 may output to the driver of the vehicle that cannot travel automatically, as the first vehicle, an instruction to park in a vacant parking space (for example, the location of the vacant parking space or a travel route thereto may be output on a display).

Circumstances Arising at Time of Parking

Figure 2:
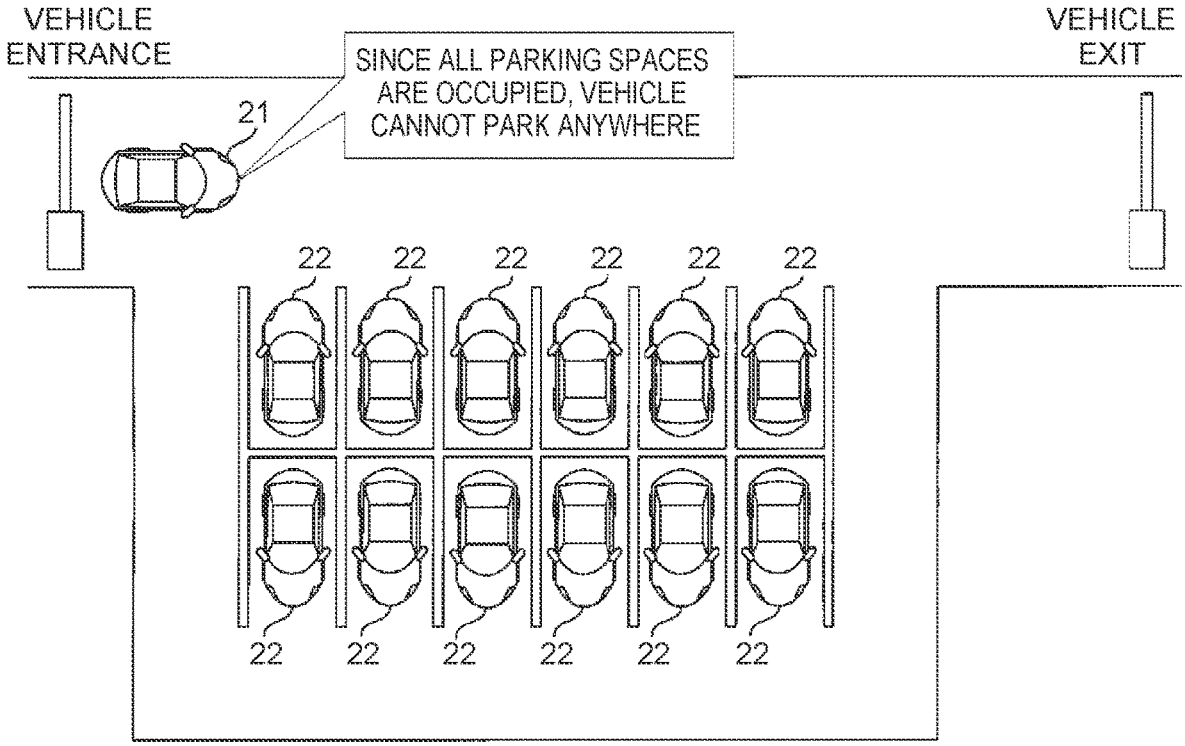
FIG. 2 is a plan view showing the circumstances that may occur when a parking lot is full.

Next, technical issues that may be generated at the time of parking of the vehicle 20 will be described with reference to FIG. 2. FIG. 2 is a plan view showing the circumstances that may arise when a parking lot is full. The circumstances described below arise in a parking assist device (hereinafter suitably referred to as "first comparative example") that is different from the parking assist device 10 according to the first embodiment.

As shown in FIG. 2, in a first comparative example, when the first vehicle 21 that is to be newly parked, as an example of the vehicle 20, comes into a parking lot, a parking space available for parking of the first vehicle 21 is searched out of a plurality of parking spaces. However, when all the parking spaces in the parking lot are occupied by the second vehicles 22 as examples of the vehicles 20 (that is, when the parking lot is full), it is not possible to find a parking space available for parking of the first vehicle 21. Accordingly, the first vehicle 21 has no other choice but giving up parking or waiting until any one of the parking spaces are vacated. In short, it is practically impossible to immediately park the first vehicle 21.

The parking assist device 10 according to the first embodiment executes the operation described below.

Description of Operation

Figure 3:
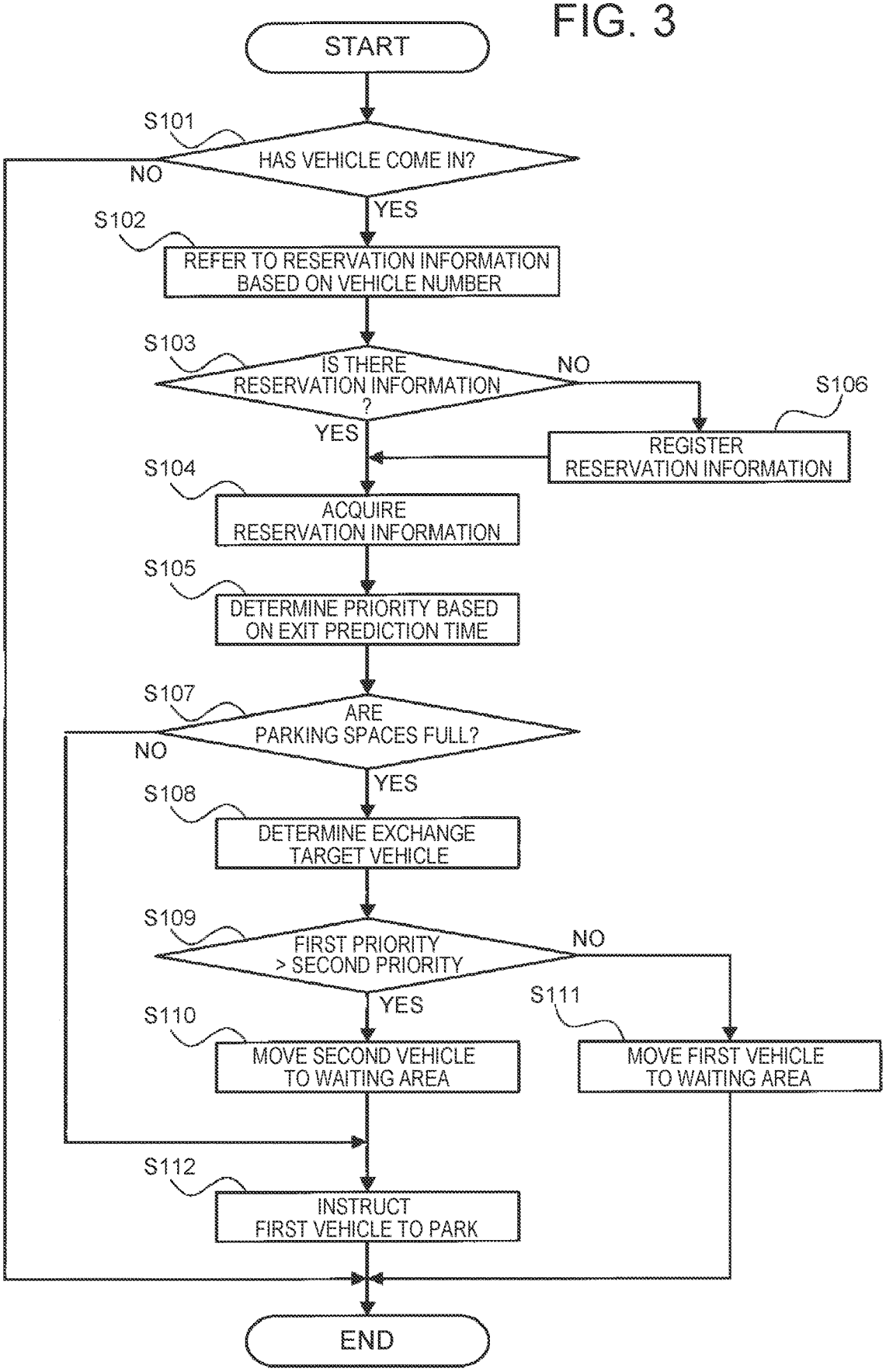
FIG. 3 is a flowchart showing an operation flow of the parking assist device according to the first embodiment.

Next, an operation flow of the parking assist device 10 according to the first embodiment will be described with reference to FIG. 3. FIG. 3 is a flowchart showing the operation flow of the parking assist device in the first embodiment. In the following description, vehicles (that is, vehicles present in the parking lot or around the parking lot) that can communicate with the parking assist device 10 are referred to as "vehicles 20." Among the vehicles 20, a vehicle that is to be newly parked in the parking lot is referred to as "first vehicle 21." Among the vehicles 20, the vehicles already parked in the parking spaces in the parking lot are referred to as "second vehicles 22."

As shown in FIG. 3, when the parking assist device 10 according to the first embodiment is operated, the parking lot monitoring unit 110 first determines whether or not a new vehicle 20 (that is, a first vehicle 21) has come into the parking lot (step S101). When the parking lot monitoring unit 110 determines that the first vehicle 21 has not come in (step S101: NO), subsequent processing is omitted, and the series of operation steps are ended. In that case, the parking assist device 10 may start processing at step S101 again after the lapse of a prescribed period.

When determining that the first vehicle 21 has come in (step S101: YES), the parking lot monitoring unit 110 detects a vehicle number of the first vehicle 21 that has come in, and refers to reservation information (step S102). The reservation information includes at least exit prediction time (for example, exit time desired by a user).

The parking lot monitoring unit 110 further determines whether or not there is reservation information corresponding to the first vehicle 21 that has come in (in other words, whether or not there is a reservation), as a result of referring to the reservation information (step S103). When there is reservation information (step S103: YES), the parking lot monitoring unit 110 acquires the reservation information (step S104), and determines parking priority based on the exit prediction time included in the reservation information (step S105). When there is no reservation information (step S104: NO), the parking lot monitoring unit 110 urges the user of the first vehicle 21 to register the reservation information (step S106), and then determines parking priority based on the exit prediction time included in the registered reservation information (step S105). The user of the first vehicle 21 can also register the exit prediction time from the outside of the first vehicle 21 using a mobile terminal, or the like.

Next, the parking lot monitoring unit 110 determines whether or not the parking spaces are occupied (step S107). In short, the parking lot monitoring unit 110 determines whether or not the second vehicles 22 are parked in all the parking spaces. The parking lot monitoring unit 110 may determine whether or not the parking spaces are occupied by using "congestion degree" instead of the vacancy situation of the parking spaces. Here "congestion degree" is a value calculated by comprehensively considering factors that cause congestion in the parking lot, such as the number of the vehicles traveling in the parking lot (that is, the vehicles moving toward the parking spaces), as well as the vacancy situation of the parking spaces. In the case of using the congestion degree, the parking lot monitoring unit 110 may determine that the parking spaces are occupied, when the congestion degree is equal to or more than a specified threshold, for example. The specified threshold in that case may be set as a value that can indicate that the congestion degree is high enough that the parking lot can be determined to be substantially full.

When the parking lot monitoring unit 110 determines that the parking spaces are not full (step S107: NO), the parking instruction unit 150 outputs to the first vehicle 21 an instruction to park in a vacant parking space (step S112). In this case, a series of operation steps are ended, without performing later-described exchange between the first vehicle 21 and the second vehicle 22. When the parking lot monitoring unit 110 determines that the parking spaces are full (step S107: YES), the exchange vehicle determination unit 120 determines, as an exchange target vehicle, the vehicle with a lowest parking priority out of the second vehicles 22 (step S108). For example, the exchange vehicle determination unit 120 may create a list including the parking priority of each of the second vehicles 22, and then determine the exchange target vehicle using the list.

Next, the priority comparator 130 compares the parking priority (hereinafter suitably referred to as "first priority") of the first vehicle 21 and the parking priority (hereinafter suitably referred to as "second priority") of the second vehicle 22 that is determined as an exchange target vehicle in the step S13 (step S109).

When the first priority is higher than the second priority (step S109: YES), the exit instruction unit 140 outputs to the second vehicle 22 that is an exchange target vehicle an instruction to exit the current parking space and move to a waiting area (step S110). Then, the second vehicle moves to the waiting area. The exchange target vehicle exits the parking space even when the exit prediction time does not come yet. In short, the parking space where the exchange target vehicle is parked until then is forcibly vacated. The waiting area to which the exchange target vehicle moves is a specific example of "place different from the parking space" in the later-described appendix. The details of the waiting area will be described later in full detail.

Next, after the second vehicle moves to the waiting area, the parking instruction unit 150 outputs to the first vehicle 21 an instruction to park in the vacant parking space (that is, the parking space where the exchange target vehicle is previously parked) (step S112). Then, the first vehicle 21 moves to the vacant parking space. Thus, when the first priority is higher than the second priority, control is executed to exchange the first vehicle 21 and the second vehicle 22.

In contrast, when the first priority is lower than the second priority (step S109: NO), the parking instruction unit 150 outputs to the first vehicle 21 an instruction to move to the waiting area (step S111). As a result, the first vehicle 21 moves to the waiting area, without parking in the parking space. Thus, when the first priority is lower than the second priority, the control to exchange the first vehicle 21 and the second vehicle 22 is not executed. In the automated valet parking lot, the user of the first vehicle 21 that is an automatically travelable vehicle gets off the first vehicle 21 (at a getting-on-and-off space outside the parking lot, for example) before the first vehicle 21 moves to the waiting area. Therefore, no special problem arises even when the first vehicle 21 is not parked in the parking space.

Technical Effects

Figure 4:
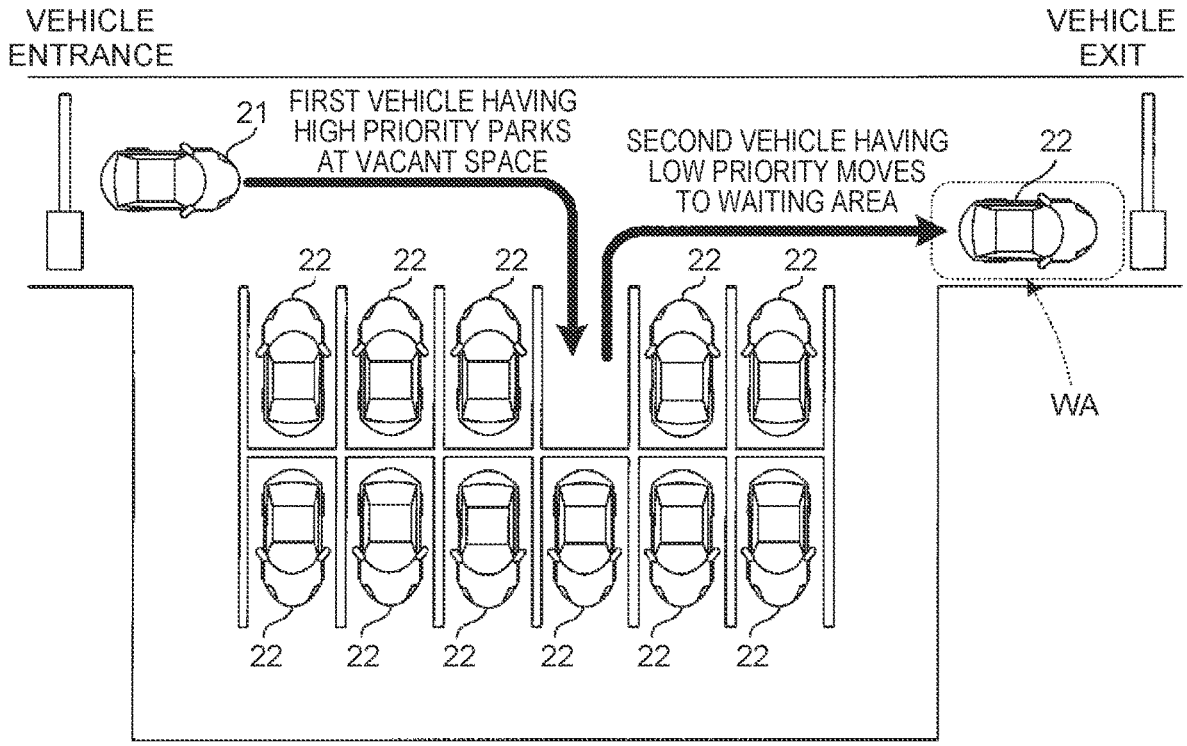
FIG. 4 is a plan view showing an example of vehicle movement by the parking assist device according to the first embodiment.

Next, the technical effects that can be achieved by the parking assist device 10 according to the first embodiment will be described with reference to FIG. 4. FIG. 4 is a plan view showing an example of vehicle movement by the parking assist device according to the first embodiment.

As shown in FIG. 4, in the parking assist device 10 according to the first embodiment, even when the parking spaces are full, the first vehicle 21 is able to park in a parking space in accordance with the parking priority. Specifically, when the first priority (that is, the priority of the first vehicle 21) is higher than the second priority (parking priority of the second vehicle 22), the second vehicle 22 with a low parking priority exits the parking space, and the first vehicle 21 with a high parking priority parks in the vacated parking space. The parking assist device 10 according to the first embodiment can preferentially park the vehicles with a high parking priority, even when there is no vacant parking space.

The waiting area WA to which the vehicle with a low parking priority is moved is set at a location which does not prevent travel of other vehicles. Setting such a waiting area WA allows effective use of the spaces in the parking lot. In other words, the parking spaces can be vacated without taking the vehicles with a low parking priority out of the parking lot. The waiting area WA may be set as a space where a plurality of the vehicles 20 can wait.

As described before, the parking priority is determined based on the exit prediction time. In this case, the vehicle that is moved to the waiting area WA is the vehicle having an earliest exit prediction time, among the vehicles 20 present in the parking lot. Accordingly, when the waiting area WA is set in the vicinity of the exit of the parking lot as in FIG. 4, smooth exit of the vehicle 20 can be executed.

Second Embodiment

Description is now given of a parking assist device according to a second embodiment with reference to FIGS. 5 to 8. The second embodiment is generally similar to the first embodiment except for some of the configurational and behavioral aspects. Accordingly, a difference from the first embodiment will be described below in detail, and description of other redundant aspects will suitably be omitted.

Device Configuration

Figure 5:
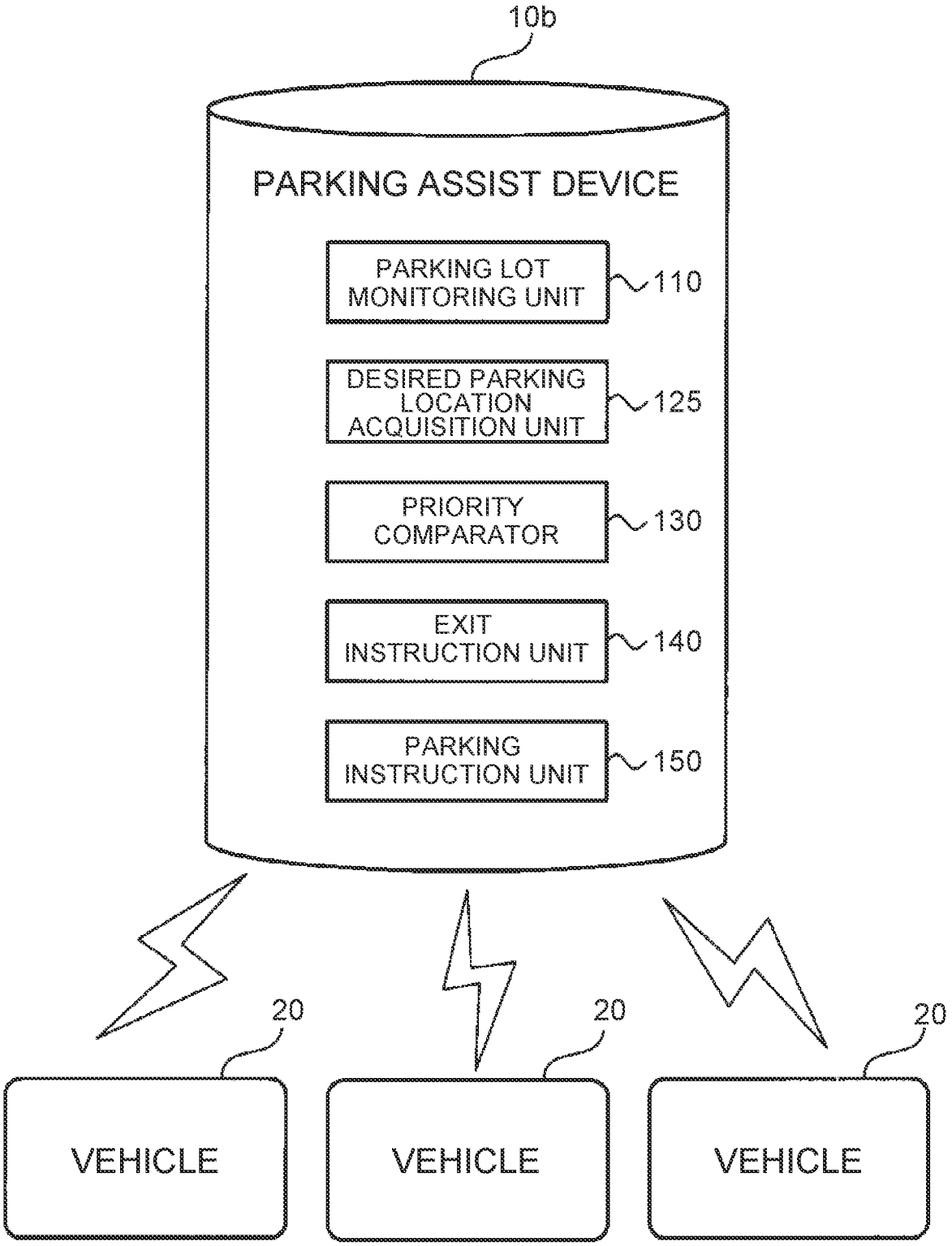
FIG. 5 is a block diagram showing the configuration of the parking assist device according to a second embodiment.

First, the configuration of the parking assist device according to the second embodiment will be described with reference to FIG. 5. FIG. 5 is a block diagram showing the configuration of the parking assist device according to the second embodiment. In FIG. 5, elements identical to those in the first embodiment shown in FIG. 1 are designated by identical numerals.

In FIG. 5, a parking assist device 10*b* according to the second embodiment is configured as a component member of a management device in a parking lot that allows automatic travel and parking of vehicles 20 as in the first embodiment.

The parking assist device 10*b* according to the second embodiment is configured to include a parking lot monitoring unit 110, a desired parking location acquisition unit 125, a priority comparator 130, an exit instruction unit 140, and a parking instruction unit 150, as logical processing blocks or physical processing circuits for implementing the functions. In short, the parking assist device 10*b* according to the second embodiment includes the desired parking location acquisition unit 125 in place of the exchange vehicle determination unit 120 of the parking assist device 10 according to the first embodiment.

The desired parking location acquisition unit 125 is configured to be able to acquire information regarding a desired parking location (that is, the location of a specific parking space desired by an occupant of the vehicle 20) from the first vehicle 21 that is to be newly parked. The desired parking location can be acquired from reservation information. In short, the reservation information of the second embodiment includes at least the exit prediction time and the desired parking location.

Circumstances Arising at Time of Parking

Figure 6:
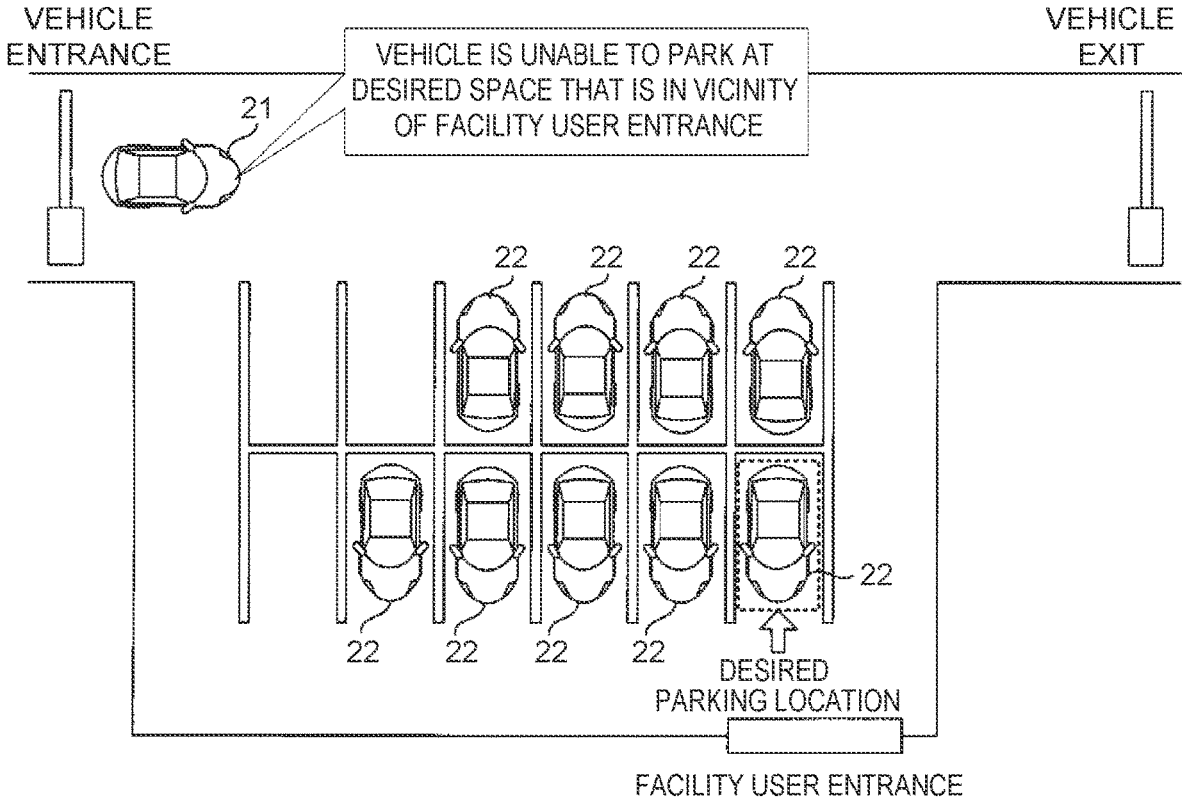
FIG. 6 is a plan view showing the circumstances that may occur even when the parking lot is not full.

Next, the circumstances that may occur at the time of parking of the vehicle 20 will be described with reference to FIG. 6. FIG. 6 is a plan view showing the circumstances that may occur even when the parking lot is not full. The circumstances described below arise in a parking assist device (hereinafter suitably referred to as "second comparative example") that is different from the parking assist device 10*b* according to the second embodiment.

In FIG. 6, it is assumed that an occupant of the first vehicle 21 that is to be newly parked as an example of the vehicle 20 desires to park in a parking space (that is, the parking space at the right end of a lower row in the drawing) closest to a facility user entrance. However, the desired parking location is occupied at present. In this case, in the second comparative example, it is determined that there is no available parking space, and the vehicle is instructed to wait until the parking space becomes vacant. Alternatively, the vehicle is instructed to park in any vacant parking space (that is, a parking space distant from the facility user entrance). Hence, it is practically impossible to immediately park for the first vehicle 21 at the desired parking location.

The parking assist device 10*b* according to the second embodiment executes the operation described below.

Description of Operation

Figure 7:
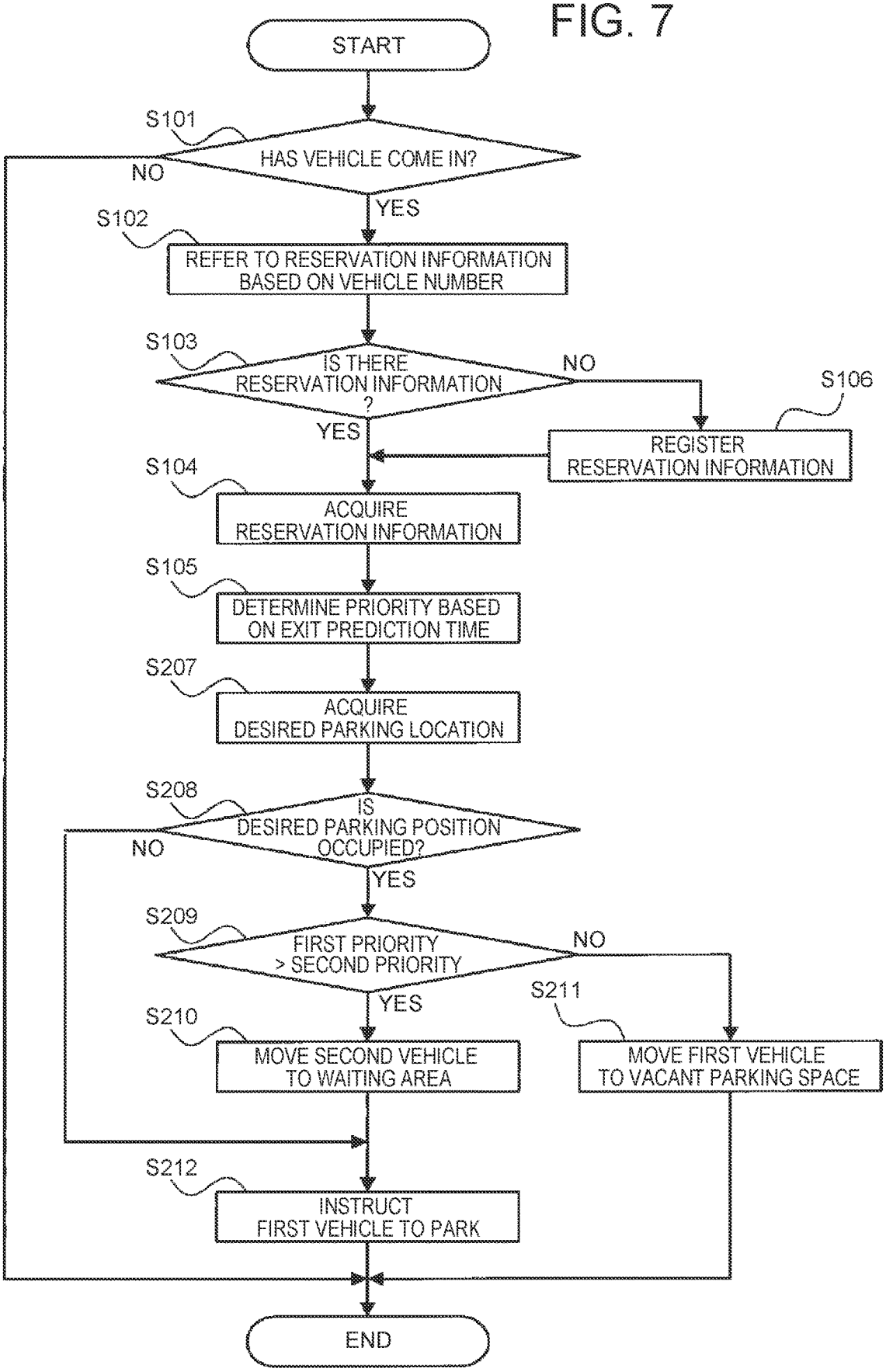
FIG. 7 is a flowchart showing an operation flow of the parking assist device according to the second embodiment.

Description is now given of an operation flow of the parking assist device 10*b* according to the second embodiment with reference to FIG. 7. FIG. 7 is a flowchart showing the operation flow of the parking assist device according to the second embodiment. In the following description, vehicles (that is, vehicles present in the parking lot or around the parking lot) that can communicate with the parking assist device 10*b* are referred to as "vehicles 20." Among the vehicles 20, a vehicle that is to be newly parked in the parking lot is referred to as "first vehicle 21." Among the vehicles 20, the vehicles already parked in the parking spaces in the parking lot are referred to as "second vehicles 22."

As shown in FIG. 7, when the parking assist device 10*b* according to the second embodiment is operated, processing of steps S101 to S106 is first executed as in the first embodiment. In short, the same processing as the first embodiment is executed until the parking priority of the first vehicle 21 that has newly come in is determined. However, as stated above, the reservation information according to the second embodiment needs to include, as a prerequisite the desired parking location as well as the exit prediction time. Accordingly, when reservation information is registered in step S106, the parking lot monitoring unit 110 urges the user of the first vehicle 21 to input the desired parking location in addition to the exit prediction time. Alternatively, when the reservation information does not include the desired parking location, the parking lot monitoring unit 110 may determine that subsequent processing is not executable at the time, and proceeds to the processing of step S107 in FIG. 2 (that is, the parking lot monitoring unit 110 may proceed to the exchange operation, when the parking spaces of the first embodiment are full).

Particularly in the second embodiment, after step S105 is executed, the desired parking location acquisition unit 125 acquires the desired parking location from the first vehicle 21 (step S207).

Next, the parking lot monitoring unit 110 determines whether or not the desired parking location is occupied (step S208). When the parking lot monitoring unit 110 determines that the desired parking space is not occupied (step S208: NO), the parking instruction unit 150 outputs to the first vehicle 21 an instruction to park in the desired parking location (step S212). In this case, a series of operation steps are ended, without performing later-described exchange between the first vehicle 21 and the second vehicle 22.

When the parking lot monitoring unit 110 determines that the desired parking location is occupied (step S208: YES), the priority comparator 130 compares the parking priority (that is, the first priority) of the first vehicle 21, and the parking priority (that is, the second priority) of the second vehicle 22 (step S209).

When the first priority is higher than the second priority (step S209: YES), the exit instruction unit 140 outputs to the second vehicle 22 that is parked in the desired parking location an instruction to exit the parking space and move to the waiting area WA (step S210). Then, the second vehicle 22 moves to the waiting area WA. The desired parking location that is occupied till then is vacated. When any vacant parking space is present, the second vehicle 22 may move to the vacant parking space instead of the waiting area WA.

Next, after the second vehicle 22 moves to the waiting area WA, the parking instruction unit 150 outputs to the first vehicle 21 an instruction to park in the vacated desired parking location (step S212). Thus, when the first priority is higher than the second priority, control is executed to exchange the first vehicle 21 and the second vehicle 22.

In contrast, when the first priority is lower than the second priority (step S209: NO), the parking instruction unit 150 outputs to the first vehicle 21 an instruction to park in any vacant parking space other than the desired parking location (step S211). When there is no vacant parking space, the parking instruction unit 150 may output to the first vehicle 21 an instruction to move to the waiting area WA.

Technical Effects

Figure 8:
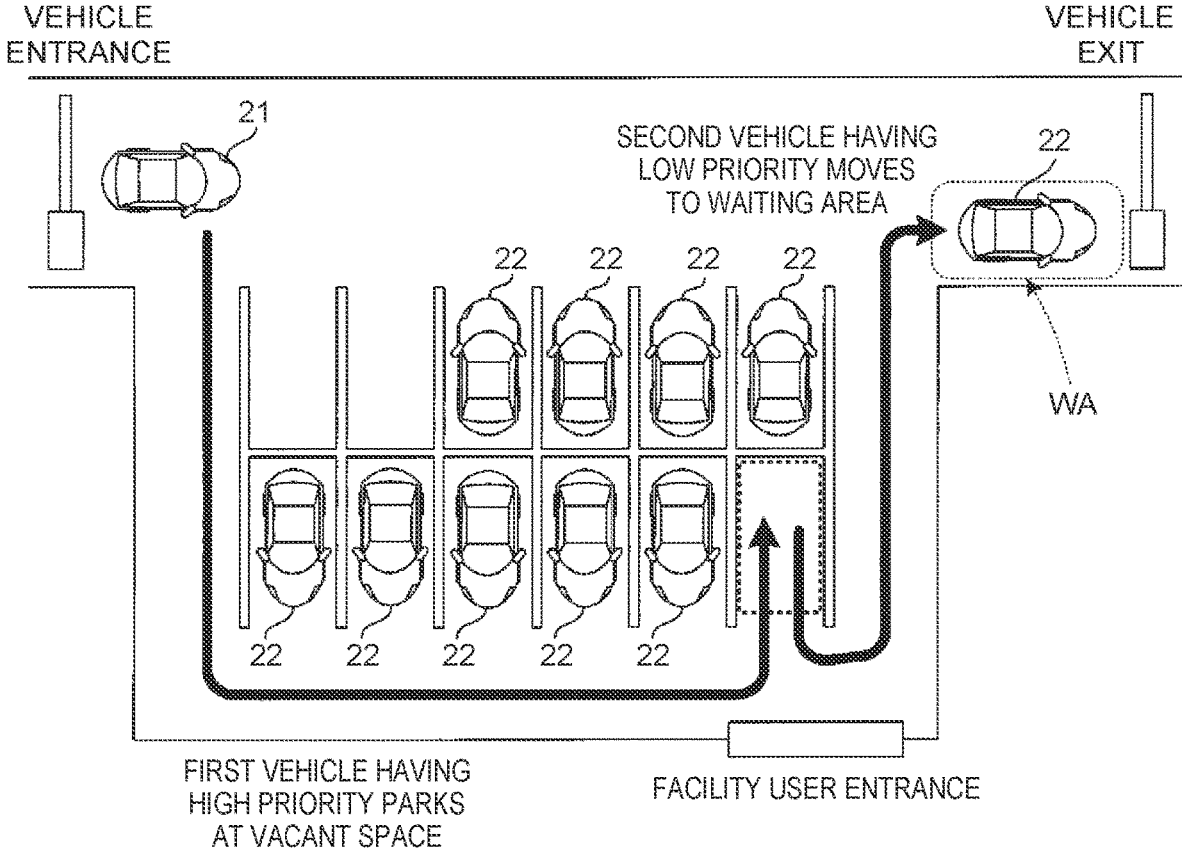
FIG. 8 is a plan view showing an example of vehicle movement by the parking assist device according to the second embodiment.

Next, the technical effects that can be achieved by the parking assist device 10*b* according to the second embodiment will be described with reference to FIG. 8. FIG. 8 is a plan view showing an example of vehicle movement by the parking assist device according to the second embodiment.

As shown in FIG. 8, in the parking assist device 10*b* according to the second embodiment, the first vehicle 21 is able to park in the desired parking location in accordance with the parking priority, even when the desired parking location is occupied. Specifically, when the first priority (that is, the priority of the first vehicle 21) is higher than the second priority (parking priority of the second vehicle 22), the second vehicle 22 with a low parking priority exits the parking space that is the desired parking location, and the first vehicle 21 with a high parking priority parks in the thus-vacated desired parking location. In the parking assist device 10 according to the second embodiment, when an occupant of the first vehicle 21 desires to park in a specific parking space, it is possible to provide an appropriate parking space in accordance with the parking priority.

In the description of the above embodiment, one parking space is specified as a desired parking location. However, a plurality of parking spaces (for example, two or more parking spaces close to the facility user entrance, or the like) may be specified as the desired parking location. In that case, among the second vehicles 22 parked in the parking spaces specified as the desired parking location, the second vehicle 22 with a lowest parking priority may be determined as an exchange target vehicle, and the parking priority of the first vehicle 21 and the parking priority of the exchange target vehicle may be compared.

Various aspects of the disclosure derived from the embodiments described above will be described below.

A parking assist device according to a first aspect of the present disclosure includes: a comparator configured to compare parking priority of a first vehicle and the parking priority of a second vehicle, the first vehicle being a vehicle that is to be newly parked in a parking section including at least one parking space, the second vehicle being an automatically travelable vehicle that is already parked in a first parking space included in the parking section, the parking priority being priority regarding use of the parking space; a first instruction unit configured to output, to the second vehicle, a signal instructing to exit the first parking space by automatic travel, when the parking priority regarding use of the first parking space of the first vehicle is higher than that of the second vehicle; and a second instruction unit configured to output, to the first vehicle, a signal in instructing to park in the first parking space, when the parking priority regarding the use of the first paring space of the first vehicle is higher than that of the second vehicle.

According to the aspect, when the parking priority of the first vehicle that is to be newly parked is higher than the parking priority of the second vehicle that is already parked, an instruction is output to the second vehicle to exit the one parking space where the second vehicle is parked. Accordingly, the first vehicle with a high parking priority can be parked in the vacated one parking space. In this configuration, it becomes possible to park the vehicle with a relatively high parking priority in preference to the vehicle with a relatively low parking priority.

The first vehicle may be an automatically travelable vehicle, or may be a vehicle that requires a driver to operate at the time of parking (that is, a vehicle that is not an automatically travelable vehicle). When the first vehicle is a vehicle that requires the driver to operate at the time of parking, the second instruction unit may output an instruction such that the instruction for parking in the one parking space is notified to the driver of the first vehicle by voice, image, or the like, for example (that is, the instruction output by the second instruction unit may be voice data or image data, for example)

In the above aspect, the comparator may be configured to compare the parking priority when a congestion degree of the parking section is more than a specified threshold.

According to the configuration, the parking priority is compared only when the congestion degree of the parking section is relatively high. This makes it possible to prevent exchange between the first vehicle and the second vehicle from being executed also in the case where the congestion degree of the parking section is relatively low (that is, in the case where there are many vacant parking spaces).

In the above aspect, the first instruction unit may be configured to output, to the second vehicle, a signal instructing to move to a waiting area that is a place different from the parking space, the waiting area being in a vicinity of an exit of the parking section when the parking priority regarding the use of the first parking space of the first vehicle is higher than that of the second vehicle.

According to the above configuration, the second vehicle instructed to exit the parking space is moved to a place different from the parking space in the vicinity of the exit. Hence, subsequent smooth exit from the parking section can be achieved.

In the above aspect, the second instruction unit may be configured to output, to the first vehicle, a signal instructing to park in the first parking space by automatic travel when the first vehicle is automatically travelable and when the parking priority regarding the use of the first parking space of the first vehicle is higher than that of the second vehicle.

According to the configuration, it is possible to park the first vehicle, by automatic travel, at the parking space vacated by the exit of the second vehicle.

In the above aspect, the parking priority may be a value that becomes higher as an exit prediction time of the vehicle from the parking section is later.

According to the configuration, the parking priority can adequately be set based on the exit prediction time of the vehicle.

In the above aspect, the parking priority may be a value that becomes higher as a remaining cruising distance of the vehicle is shorter.

According to the configuration, the parking priority can adequately be set based on the cruising distance of the vehicle.

In the above aspect, the parking priority may be a value that becomes higher as a fuel consumption rate or an electric power consumption rate relating to travel of the vehicle is larger.

According to the configuration, the parking priority can adequately be set based on the fuel consumption rate or electric power consumption rate of the vehicle.

In the above aspect, the parking priority may be a value that becomes higher as an inhibition degree of the vehicle is larger, the inhibition degree being a degree of inhibiting travel of another vehicle other than the vehicle, when the vehicle is present on a roadway in the parking section.

According to the configuration, the parking priority can adequately be set based on the inhibition degree with respect to the other vehicles.

In the above aspect, the second instruction unit may be configured to output to the first vehicle a signal instructing to move to the waiting area, when the parking priority regarding to the use of the first parking space of the first vehicle is equal to or less than that of the second vehicle.

In the above aspect, the parking assist device may further include an exchange vehicle determination unit configured to determine as an exchange target vehicle a vehicle with a lowest parking priority, among the vehicles parked in a plurality of parking spaces, the plurality of parking spaces being included in the parking section when the plurality of parking spaces are full, wherein the second vehicle is the exchange target vehicle.

In the above aspect, the comparator may be configured to compare, when the second vehicle is parked at a desired parking space, the parking priority of the first vehicle for parking in the desired parking space and the parking priority of the second vehicle for parking in the desired parking space, the desired parking space being the parking space where an owner of the first vehicle desires to park; the first instruction unit may be configured to output, to the second vehicle, a signal instructing to exit the desired parking space by automatic travel when the parking priority of the first vehicle for parking in the desired parking space is higher than the parking priority of the second vehicle for parking in the desired parking space; and the second instruction unit may be configured to output, to the first vehicle, a signal instructing to park in the desired parking space when the parking priority of the first vehicle for parking in the desired parking space is higher than the parking priority of the second vehicle for parking in the desired parking space.

A method for parking assist according to a second aspect of the present disclosure includes: comparing, by using circuitry, parking priority of a first vehicle and the parking priority of a second vehicle, the first vehicle being a vehicle that is to be newly parked in a parking section including at least one parking space, the second vehicle being an automatically travelable vehicle that is already parked in the parking section, the parking priority being priority regarding use of the parking space; outputting, by using the circuitry, to the second vehicle, a signal indicating to exit a first parking space where the second vehicle is parked by automatic travel when the parking priority regarding use of the first parking space of the first vehicle is higher than that of the second vehicle; and outputting, by using the circuitry, to the first vehicle, a signal instructing to park in the first parking space when the parking priority regarding the use of the first parking space of the first vehicle is higher than that of the second vehicle.

In the above aspect, the parking assist method may further include outputting, by using the circuitry, to the second vehicle, a signal instructing to move to a waiting area (WA) that is a place different from the parking space, the waiting area being in a vicinity of an exit of the parking section when the parking priority regarding the use of the first parking space of the first vehicle is higher than that of the second vehicle A parking assist system according to a third aspect of the present disclosure includes: a first vehicle; a second vehicle different from the first vehicle; and circuitry configured to compare parking priority of a first vehicle and the parking priority of a second vehicle, the first vehicle being a vehicle that is to be newly parked in a parking section including at least one parking space, the second vehicle being an automatically travelable vehicle that is already parked in the parking section, the parking priority being priority regarding use of the parking space; output, to the second vehicle, an exit signal indicating to exit a first parking space where the second vehicle is parked by automatic travel when the parking priority regarding use of the first parking space of the first vehicle is higher than that of the second vehicle; and output, to the first vehicle, a park signal instructing to park in the first parking space when the parking priority regarding the use of the first parking space of the first vehicle is higher than that of the second vehicle, wherein the second vehicle exits the first parking space by the automatic travel when the second vehicle receives the exit signal.

In the above aspect, the first vehicle may be parked in the first parking space after the second vehicle exits the first parking space when the first vehicle receives the parking signal.

In the above aspect, the first vehicle may be parked in the first parking by the automatic travel.

In the above aspect, the first vehicle may be parked in the first parking by an operation by a driver of the first vehicle.

What is claimed is:

1. A parking assist device, comprising:

a comparator configured to compare parking priority of a first vehicle and the parking priority of a second vehicle, the first vehicle being a vehicle that is to be newly parked in a parking section including at least one parking space, the second vehicle being an automatically travelable vehicle that is already parked in a first parking space included in the parking section, the parking priority being priority regarding use of the parking space;

a first instruction unit configured to output, to the second vehicle, a signal instructing to exit the first parking space by automatic travel, when the parking priority regarding use of the first parking space of the first vehicle is higher than that of the second vehicle; and a second instruction unit configured to output, to the first vehicle, a signal in instructing to park in the first parking space, when the parking priority regarding the use of the first paring space of the first vehicle is higher than that of the second vehicle.

2. The parking assist device according to claim 1, wherein the comparator is configured to compare the parking priority when a congestion degree of the parking section is more than a specified threshold.

3. The parking assist device according to claim 1, wherein the first instruction unit is configured to output, to the second vehicle, a signal instructing to move to a waiting area that is a place different from the parking space, the waiting area being in a vicinity of an exit of the parking section when the parking priority regarding the use of the first parking space of the first vehicle is higher than that of the second vehicle.

4. The parking assist device according to claim 3, wherein the second instruction unit is configured to output to the first vehicle a signal instructing to move to the waiting area, when the parking priority regarding to the use of the first parking space of the first vehicle is equal to or less than that of the second vehicle.

5. The parking assist device according to claim 1, wherein the second instruction unit is configured to output, to the first vehicle, a signal instructing to park in the first parking space by automatic travel when the first vehicle is automatically travelable and when the parking priority regarding the use of the first parking space of the first vehicle is higher than that of the second vehicle.

6. The parking assist device according to claim 1, wherein the parking priority is a value that becomes higher as an exit prediction time of the vehicle from the parking section is later.

7. The parking assist device according to claim 1, wherein the parking priority is a value that becomes higher as a remaining cruising distance of the vehicle is shorter.

8. The parking assist device according to claim 1, wherein the parking priority is a value that becomes higher as a fuel consumption rate or an electric power consumption rate relating to travel of the vehicle is larger.

9. The parking assist device according to claim 1, wherein:

the parking priority is a value that becomes higher as an inhibition degree of the vehicle is larger, and the inhibition degree indicates a degree of inhibiting travel of another vehicle other than the vehicle, when the vehicle is present on a roadway in the parking section.

10. The parking assist device according to claim 1, further comprising an exchange vehicle determination unit configured to determine, as an exchange target vehicle, a vehicle with a lowest parking priority, among a plurality of vehicles parked in a plurality of the parking spaces, the plurality of parking spaces being included in the parking section, wherein the second vehicle is the exchange target vehicle.

11. The parking assist device according to claim 1, wherein:

the comparator is configured to compare, when the second vehicle is parked at a desired parking space, the parking priority of the first vehicle for parking in the desired parking space and the parking priority of the second vehicle for parking in the desired parking space, the desired parking space being the parking space where an owner of the first vehicle desires to park;

the first instruction unit is configured to output, to the second vehicle, a signal instructing to exit the desired parking space by automatic travel when the parking priority of the first vehicle for parking in the desired parking space is higher than the parking priority of the second vehicle for parking in the desired parking space; and the second instruction unit is configured to output, to the first vehicle, a signal instructing to park in the desired parking space when the parking priority of the first vehicle for parking in the desired parking space is higher than the parking priority of the second vehicle for parking in the desired parking space.

12. A parking assist method, comprising:

comparing, by using circuitry, parking priority of a first vehicle and the parking priority of a second vehicle, the first vehicle being a vehicle that is to be newly parked in a parking section including at least one parking space, the second vehicle being an automatically travelable vehicle that is already parked in the parking section, the parking priority being priority regarding use of the parking space;

outputting, by using the circuitry, to the second vehicle, a signal indicating to exit a first parking space where the second vehicle is parked by automatic travel when the parking priority regarding use of the first parking space of the first vehicle is higher than that of the second vehicle; and outputting, by using the circuitry, to the first vehicle, a signal instructing to park in the first parking space when the parking priority regarding the use of the first parking space of the first vehicle is higher than that of the second vehicle.

13. The parking assist method according to claim 12, further comprising outputting, by using the circuitry, to the second vehicle, a signal instructing to move to a waiting area that is a place different from the parking space, the waiting area being in a vicinity of an exit of the parking section when the parking priority regarding the use of the first parking space of the first vehicle is higher than that of the second vehicle.

14. A parking assist system comprising:

a first vehicle;

a second vehicle different from the first vehicle; and circuitry configured to compare parking priority of the first vehicle and the parking priority of the second vehicle, the first vehicle being a vehicle that is to be newly parked in a parking section including at least one parking space, the second vehicle being an automatically travelable vehicle that is already parked in the parking section, the parking priority being priority regarding use of the parking space;

output, to the second vehicle, an exit signal indicating to exit a first parking space where the second vehicle is parked by automatic travel when the parking priority regarding use of the first parking space of the first vehicle is higher than that of the second vehicle; and output, to the first vehicle, a park signal instructing to park in the first parking space when the parking priority regarding the use of the first parking space of the first vehicle is higher than that of the second vehicle, wherein the second vehicle exits the first parking space by the automatic travel when the second vehicle receives the exit signal.

15. The parking assist system according to claim 14, wherein the first vehicle is parked in the first parking space after the second vehicle exits the first parking space when the first vehicle receives the parking signal.

16. The parking assist system according to claim 15, wherein the first vehicle is parked in the first parking by the automatic travel.

17. The parking assist system according to claim 15, wherein the first vehicle is parked in the first parking by an operation by a driver of the first vehicle.

* * * * *